US006268798B1

(12) United States Patent
Dymek et al.

(10) Patent No.: US 6,268,798 B1
(45) Date of Patent: Jul. 31, 2001

(54) FIREFIGHTER EMERGENCY LOCATOR SYSTEM

(76) Inventors: David L. Dymek; Beverly J. Dymek, both of 7 Elizabeth Ct., Downington, PA (US) 19335

( * ) Notice: Subject to any disclaimer, the term of this patent is extended or adjusted under 35 U.S.C. 154(b) by 0 days.

(21) Appl. No.: 09/621,300

(22) Filed: Jul. 20, 2000

(51) Int. Cl.[7] ..... G08B 23/00

(52) U.S. Cl. ..... 340/573.1; 340/332; 340/825.69; 340/825.72; 340/10.52; 340/10.6; 182/18; 342/357.01; 342/357.06

(58) Field of Search ..... 340/573.1, 539, 340/332, 330, 10.41, 825.69, 825.72, 10.52, 10.6; 182/18; 342/357.01, 352, 450, 357.06

(56) References Cited

U.S. PATENT DOCUMENTS

| | | | | |
|---|---|---|---|---|
| 5,289,163 | * | 2/1994 | Perez et al. | 340/539 |
| 5,541,579 | | 7/1996 | Kiernan | 340/573 |
| 5,621,388 | | 4/1997 | Sherburne et al. | 340/573 |
| 5,644,294 | | 7/1997 | Ness | 340/540 |
| 5,689,234 | | 11/1997 | Stumberg | 340/521 |
| 5,742,233 | * | 4/1998 | Hoffman et al. | 340/573.1 |
| 5,898,392 | * | 4/1999 | Bambini et al. | 340/996 |
| 5,990,793 | * | 11/1999 | Bieback | 340/573.1 |
| 6,140,956 | * | 10/2000 | Hillman et al. | 342/357.07 |

* cited by examiner

*Primary Examiner*—Julie Lieu
(74) *Attorney, Agent, or Firm*—Henderson & Sturm LLP

(57) ABSTRACT

An emergency locator system (10) for firefighters (100) including a first housing unit (11) carried by a firefighter and containing a global positioning receiver unit (12), a memory unit (13), and a data transmitting unit (13) which communicates continuous positional data relative to the location of the first housing unit (11) to a central processing unit (15) that can store, retrieve, and transfer the positional data from the first housing unit (11) to a second housing unit (11') that includes at least a memory unit (60) that is associated with an LED array (40) having directional arrow icons (45) that are activated by the transferred positional data from the first housing unit (11) to permit rescuers to retrace the path of travel of the first housing unit (11) by using the second housing unit (11') to locate a disabled firefighter.

13 Claims, 3 Drawing Sheets

FIREFIGHTER EMERGENCY LOCATOR SYSTEM

BACKGROUND OF THE INVENTION

1. Field of the Invention

The present invention relates to the field of personal alarm signaling systems in general, and in particular to a system that allows rescuers to retrace the path of a disabled firefighter.

2. Description of Related Art

As can be seen by reference to the following U.S. Pat. Nos. 5,541,579; 5,621,388; 5,644,294; 5,990,793; and 5,689,234, the prior art is replete with myriad and diverse firefighter locator systems.

While all of the aforementioned prior art constructions are more than adequate for the basic purpose and function for which they have been specifically designed, they are uniformly deficient with respect to their failure to provide a simple, efficient, and practical device that will provide rescue personnel with not only the present location of a disabled firefighter, but also the exact route taken by that firefighter from the time that they entered a burning building up until the present time.

While many of the current systems transmit data as to the present location of a disabled firefighter, it is of little or no value to the rescuers if they do not know which floor the disabled firefighter is on, or exactly how the disabled firefighter arrived at their present location.

A tragically classical example of this problem recently played out in New England. Several firefighters became disabled in a multi story warehouse that had a labyrinth arrangement of interior walls and partitions that totally frustrated all rescue attempts. Furthermore, when the tragedy was reenacted, it became apparent that the rescuers had come within 25 feet of one or more of the fallen firefighters, but could not reach them due to the presence of one or more structural walls between the rescuers and the firefighters.

As a consequence of the foregoing situation, there has existed a longstanding need among firefighters for a new and improved personal emergency locator system that will allow rescuers to exactly retrace any individual firefighters path of travel into a burning structure so that the rescuers can go directly to the location of the disabled firefighter, and the provision of such a system is a stated objective of the present invention.

BRIEF SUMMARY OF THE INVENTION

Briefly stated, the emergency locator system for firefighters that forms the basis of the present invention comprises in general a central processing unit which interacts with a global positioning receiver unit, a data transmitting unit, and a memory unit contained within a body worn housing unit that is carried by the individual firefighters responding to a blaze.

As will be explained in greater detail further on in the specification, the body worn housing unit is provided with data entry and control buttons, as well as LED indicators. The firefighter activates the global positioning receiver unit immediately upon entering a building so that the memory unit can record the exact distances and directions traveled by the firefighter within a building and simultaneously transmit that information, as well as the firefighters PIN code via the data transmitting unit to the central processing unit.

In addition, the housing unit is further provided with both emergency signaling means, as well as means for indicating when a firefighter ascends or descends a stairwell. Then, if a firefighter encounters an emergency situation and becomes disabled, he or she can immediately notify the central processing unit which identifies the firefighter needing assistance and download their exact route of travel into the memory unit of a companion housing unit that will be carried by rescue personnel as they retrace the path of travel of the disabled firefighter.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
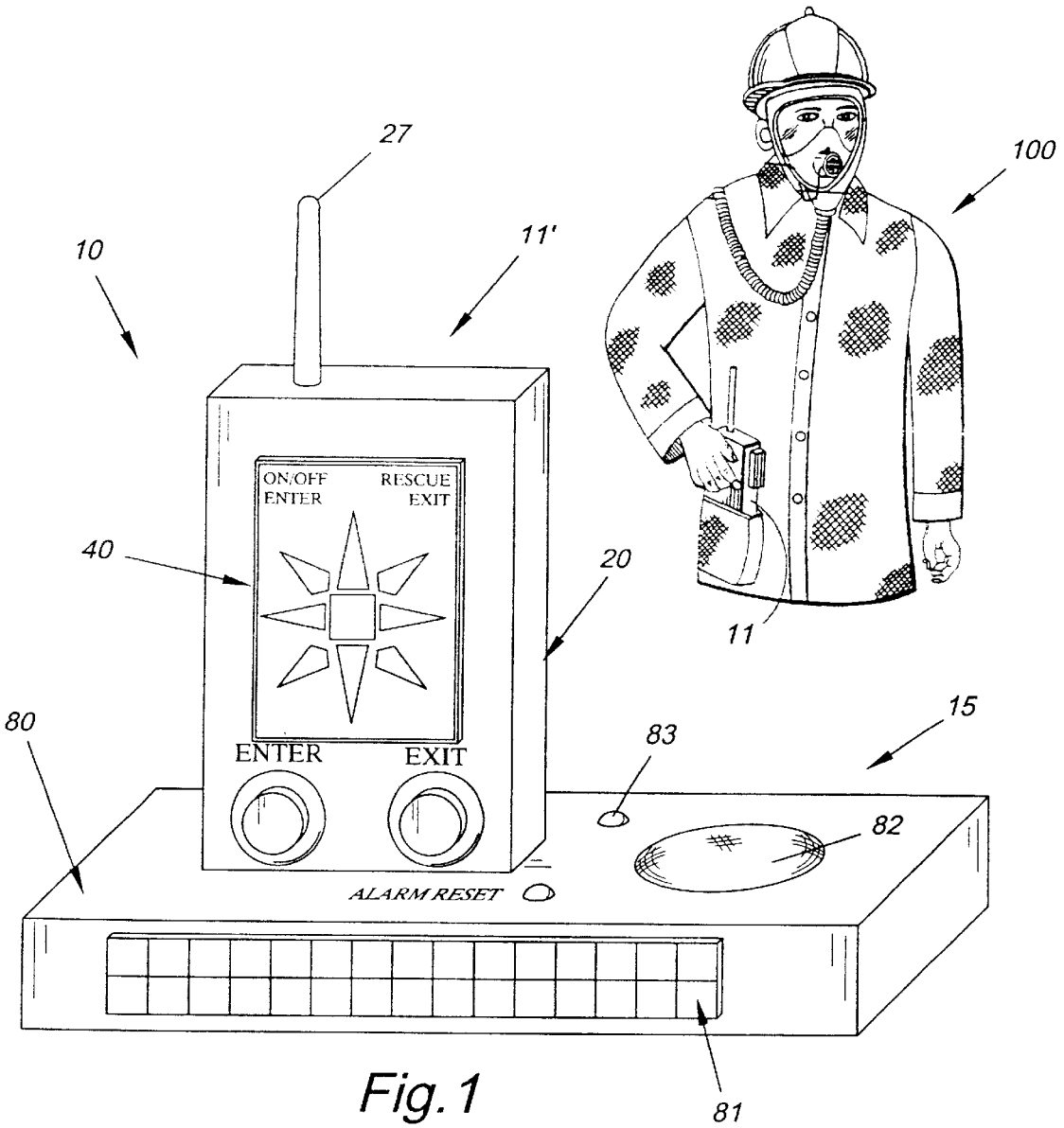
FIG. 1 is a perspective view of the emergency locator system that forms the basis of the present invention.
Figure 8:
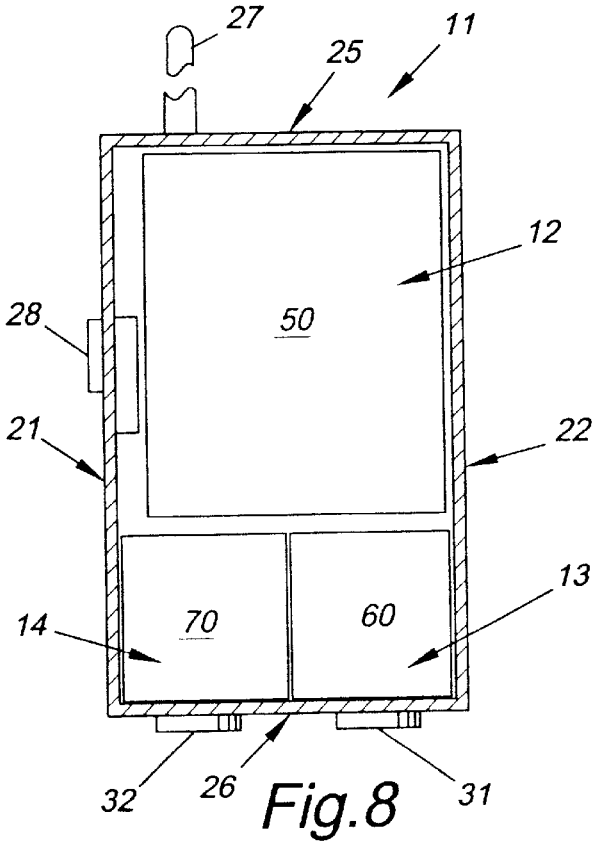
FIG. 8 is a cross sectional view taken through line 8—8 of FIG. 5.

As can be seen by reference to the drawings, and in particular to FIGS. 1 and 8, the emergency locator system for firefighters that forms the basis of the present invention is designated generally by the reference number 10. The system 10 comprises in general, two identical housing units 11, each containing a global positioning receiver unit 12, a memory unit 13, and a data transmitting unit 14 which are operatively associated with a central processing unit 15. These units will now be described in seriatim fashion.

As can best be seen by reference to FIGS. 3 through 8, each of the housing units 11 includes a portable housing body member 20 dimensioned to receive a global positioning receiver unit 12, a memory unit 13, and a data transmission unit 14 whose purposes and functions will be described in greater detail further on in the specification.

The housing body member 20 is further provided with a pair of opposed side panels 21, 22, a face panel 23, a back panel 24, a top panel 25, and a bottom panel 26. Furthermore, the top panel 25 is provided with an antennae element 27, one of the side panels 21 is provided with an on-off switch element 28, the back panel 24 is provided with a removable panel door 29 that provides access into a battery compartment 30 formed in the interior of the housing body member 20. The bottom panel 26 is provided with a pair of data download 31 and upload 32 ports and the face panel 23 is provided with a control and display array designated generally as 40.

Figure 4:
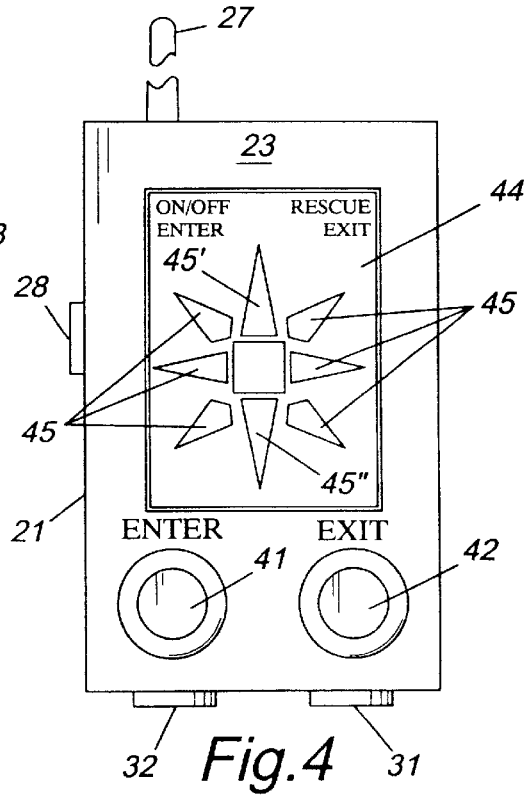
FIG. 4 is a front plan view of the firefighter's housing unit.
Figure 5:
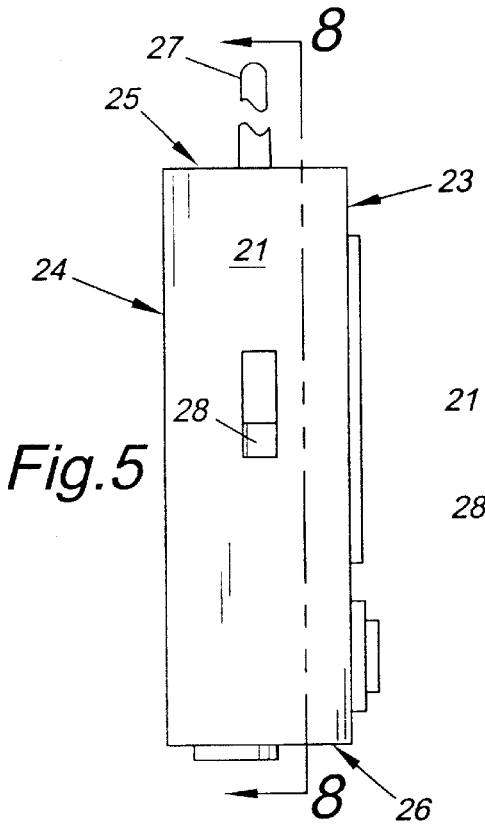
FIG. 5 is a side plan view of the firefighter's housing unit.
Figure 6:
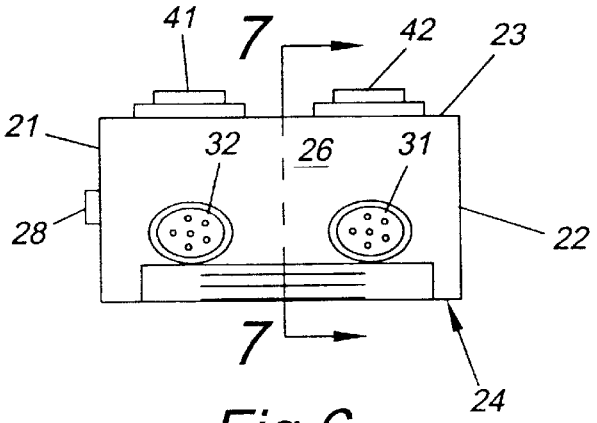
FIG. 6 is a bottom plan view of the firefighter's housing unit.

As can best be seen by reference to FIGS. 1 and 4, the control and display array 40 includes an "enter" button 41, an "exit" button 42, and directional LED display panel 44 provided with a plurality of directional arrow icons 45. The upper 45' and lower 45" icons serve a dual purpose and function in accordance with the teachings of this invention, as will be explained in greater detail further on in the specification.

Figure 7:
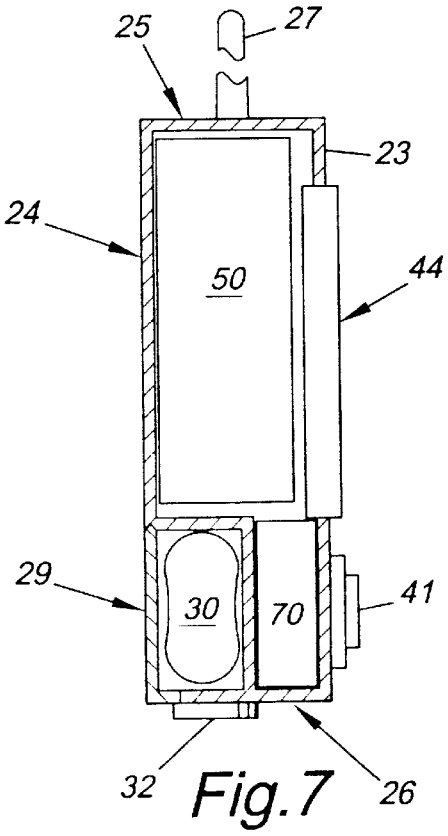
FIG. 7 is a cross sectional view of the interior of the firefighter's housing unit taken through line 7—7 of FIG. 6.

As can best be appreciated by reference to FIGS. 7 and 8, the global positioning receiver unit 12 comprises a conventional military style GPS receiver member 50 which is designed to download positional data from a satellite array (not shown) to indicate the exact position of the receiver member 50 with a high degree of precision as close as two feet from the actual position of the receiver member 50.

This positional data from the GPS receiver member 50 is then continuously recorded in the memory unit 13 which comprises a microprocessor 60 and sent via the data transmission unit 14 which comprises a data transmitter 70 connected to the transmitting antennae 27 on the top panel 25 of the housing body member 20 which relays the data in a wireless fashion to the central processing unit 15. The data transmission further includes a piggyback code containing a PIN that will reveal the identity of the firefighter that is carrying that particular housing unit 11.

Figure 2:
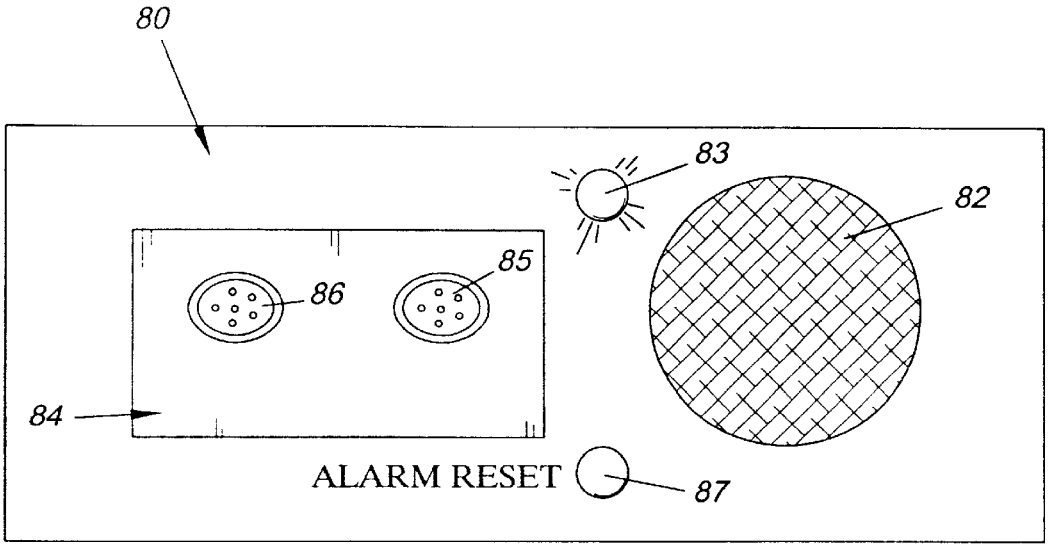
FIG. 2 is a top plan view of the central processing unit.
Figure 3:
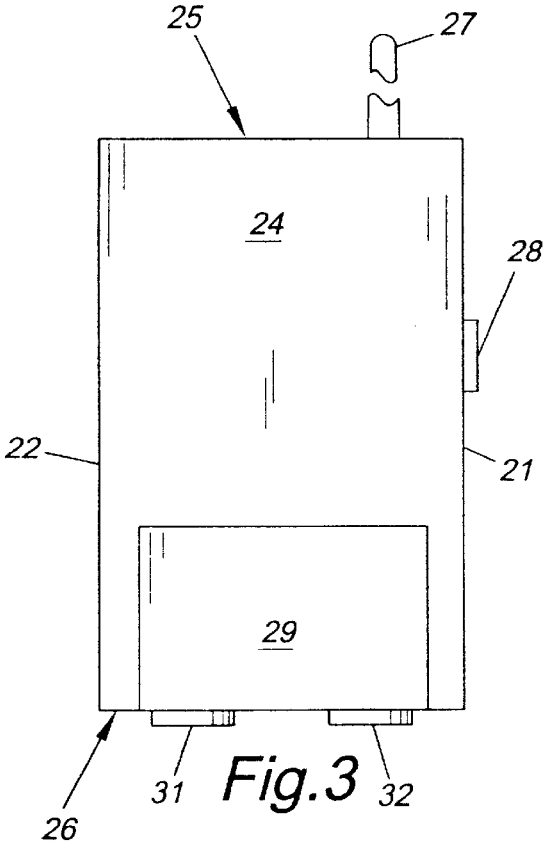
FIG. 3 is a rear plan view of the housing unit carried by a firefighter.

As shown in FIGS. 1 and 2, the central processing unit 15 comprises a central computer member 80 having a built in wireless receiver (not shown) for recording all of the coded wireless digital data from all of the housing units 11 carried by the firefighters that are being monitored by the central computer member 80.

In addition, the central computer member 80 is further provided with an alphanumeric keyboard 81, an audible alarm element 82, a visual alarm element 83, and a receptacle element 84 having data downloading 85 and uploading 86 terminals that are adapted to be received in the housing unit 11' that will be carried by the rescue personnel.

In operation, the emergency locator system 10 requires that each firefighter 100 be equipped with their own individual housing unit 11 which they will turn on via the on/off button as soon as they arrive at the site of a fire. As the firefighters enter a burning structure they will depress the "enter" button 41 which will immediately begin downloading positional data from the GPS receiver member 50 on a continuous basis which will be both stored in the microprocessor 60 and also transmitted in a wireless fashion via the transmitter member 70 to the central computer member 80.

While the "enter" button 41 is depressed, the LCD display 44 will be uniformly illuminated to clearly delineate the exit button 42 which will remain illuminated as long as the on/off switch 28 is turned to the "on" position.

Furthermore, as the firefighter initially progresses through a building and encounters a stairwell it will be necessary for the firefighter to depress the upper directional icon 45' in a particular fashion or sequence to record the fact that the firefighter is traveling up a stairwell or depress the lower directional icon 45" in a similar fashion to indicate that the firefighter is going down a stairwell, with this information being both stored in the microprocessor 60 and relayed to the central computer member 80 via the data transmitter member 70.

Under normal operating conditions, the exit button 42 will never have to be depressed as long as the firefighter is able bodied. If he or she becomes disoriented, they will be able to egress from the building simply by depressing the exit button 42 and follow the illuminated directional arrow icons 45.

The depression of the "exit" button 42 downloads the positional data stored in the microprocessor 60 in reverse order to selectively illuminate in sequential fashion a single arrow icon 45 that corresponds to the desired direction of travel that the firefighter must take to retrace their path out of the building. In addition, when the firefighter encounters a stairwell either the upper 45' or lower 45" arrow icon will flash accompanied by loud audible beeps to remind the firefighter which direction to take the staircase to exit the building.

In an emergency situation, the firefighter would depress the exit button 42 a second time or for more than 5 seconds which would activate the transmitter 70 to send an emergency signal to the central computer member 80 causing both the audible alarm element 82 and the visual alarm element 83 to be activated to alert the person monitoring the central computer member 80 that one of the firefighters is in trouble and needs assistance.

The audible alarm element 82 will also identify the particular housing unit 11 from which the alarm signal was generated which will allow the operator of the central computer member 80 to key in the alphanumeric code of that particular housing unit 11 into the computer keyboard 81 to download all of the positional data that was previously generated from that housing unit 11.

At this juncture, a second housing unit 11' will be inserted into the receptacle 84 on the central computer member 80 to upload all of the recorded positional data for the first housing unit 11 so that the rescuers can use the second housing unit 11' to retrace the line of travel of the firefighter having the first housing unit 11.

Once the positional data has been uploaded from the central computer member 80, the leader of the rescue team will simply depress the "enter" button 41 and the pre-loaded positional data will cause the directional arrow icons 45 to sequentially illuminate to duplicate the path of travel of the firefighter who has the first housing unit 11 in his or her possession.

It should also be noted that as soon as the second housing unit 11' is removed from the computer receptacle 84, the alarm reset button 87 will be depressed to clear the central computer member 80 for subsequent emergency calls from other firefighters.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An emergency locator system for firefighters wherein the system comprises:

a pair of housing units including a first housing unit and a second housing unit wherein the first housing unit includes a first global positioning receiver unit, a first memory unit, and a first data transmitting unit operatively associated with one another; wherein the first housing unit is carried by a firefighter; and wherein the second housing unit includes at least a second memory unit;

a central processing unit including a central computer member having a receptacle dimensioned to receive said second housing unit;

means for storing positional data transmitted from said first housing into the second memory unit in said second housing unit;

means for uploading said transmitted positional data form said first housing unit into the second memory unit in said second housing unit; wherein the first global positioning receiver unit includes a GPS receiver member for continuously downloading positional date relative to the position of the first housing unit, the first memory unit includes a microprocessor having second means for storing positional data from the GPS receiver member, and the first data transmitting unit includes a data transmitter for continuously transmitting both the positional data relative to the position of the first housing unit, as well as an identifying code associated with the first housing unit to the central computer member; and wherein both the first housing unit and the second housing unit are each provided with an LED array that includes a plurality of directional arrow icons that are operatively associated with the respective first and second memory units.

2. The system as in claim 1 wherein both the first and second housing units are provided with an "enter" button and an "exit" button.

3. The system as in claim 2 wherein at least the first housing unit is provided with an emergency call button.

4. The system as in claim 3 wherein the central computer member includes:

means for storing and selectively retrieving the positional data transmitted from said first housing unit.

5. The system as in claim 4 wherein the central computer member further includes:

means for transferring the positional data from the first housing unit to the memory unit in the second housing unit.

6. The system as in claim 5 wherein the memory unit in the second housing unit will selectively illuminate the LED array in the second housing unit when the "enter" button is depressed.

7. The system as in claim 6 wherein the memory unit in the first housing unit will selectively illuminate the LED array in the first housing unit when the exit button is depressed.

8. The system as in claim 1 wherein said positional data includes directional data in both the horizontal and vertical planes.

9. A method for locating a firefighter in an emergency situation including the steps of:

(a) providing a firefighter with first means for continuously recording the position of the firefighter and storing the positional data in said first means;

(b) simultaneously transmitting said positional data from said first means to a second means for storing and selectively retrieving said positional data;

(c) transferring said positional data from said second means to a third means for storing, retrieving, and converting said positional data into directional indicia; and (d) using the directional indicia of said third means to retrace the path of travel of said firefighter to the location of said first means.

10. The method as in claim 9 wherein said positional data includes directional data in both the horizontal and vertical planes.

11. The method as in claim 10 wherein said first means comprises:

a first housing unit that includes a global positioning receiver unit, a first memory unit, and a data transmitting unit.

12. The method as in claim 11 wherein said second means comprises:

a central processing unit including a central computer member having a receptacle.

13. The method as in claim 12 wherein said third means comprises:

a second housing unit dimensioned to be received in the receptacle in the central computer member and including at least a second memory unit associated with an LED array having directional arrow icons.

* * * * *